US006112352A

United States Patent [19]

Legg

[11] Patent Number: 6,112,352

[45] **Date of Patent: *Sep. 5, 2000**

[54] KEYRING TOOL

[75] Inventor: Larry K. Legg, Leroy Township, Ohio

[73] Assignee: LKL Innovations, Ltd., Mentor, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/873,643

[22] Filed: Jun. 12, 1997

[51] Int. Cl.[7] ..... B26B 11/00

[52] U.S. Cl. ..... 7/158; 7/118; 7/170

[58] Field of Search ..... 7/118, 149, 158, 7/165, 170

[56] References Cited

U.S. PATENT DOCUMENTS

| | | | |
|---|---|---|---|
| D. 170,961 | 12/1953 | Blish . | |
| 172,195 | 1/1876 | Spring . | |
| 297,375 | 4/1884 | Freund . | |
| 311,642 | 10/1885 | MacDonald . | |
| D. 311,980 | 11/1990 | Baker . | |
| 313,414 | 3/1885 | Freund . | |
| D. 357,051 | 4/1995 | Strenkowski . | |
| 358,312 | 2/1887 | Weck | 7/118 |
| D. 381,487 | 7/1997 | Sweeney . | |
| 580,235 | 4/1897 | Strum . | |
| 591,459 | 1/1897 | Dell . | |
| 597,345 | 1/1898 | Welsh . | |
| 614,537 | 11/1898 | Dahlquist | 7/118 |
| 1,268,558 | 6/1918 | Faix . | |
| 1,440,014 | 12/1922 | Kallio . | |
| 1,454,994 | 5/1923 | Matteo . | |
| 1,561,262 | 11/1925 | Blackstun . | |
| 2,742,698 | 4/1956 | McGary et al. . | |
| 2,924,879 | 2/1960 | Kraus, Jr. . | |
| 4,233,737 | 11/1980 | Poehlmann . | |
| 4,324,121 | 4/1982 | Richter . | |
| 4,451,982 | 6/1984 | Collins . | |
| 4,570,341 | 2/1986 | Konneker | 7/118 |
| 4,637,084 | 1/1987 | Wood . | |
| 4,926,554 | 5/1990 | Martin . | |
| 5,014,379 | 5/1991 | Hull et al. . | |
| 5,062,173 | 11/1991 | Collins et al. | 7/118 |
| 5,077,850 | 1/1992 | Brubaker . | |
| 5,093,995 | 3/1992 | Jan . | |
| 5,119,520 | 6/1992 | Finn . | |
| 5,279,021 | 1/1994 | Edgin . | |
| 5,528,831 | 6/1996 | Fortenberry . | |

OTHER PUBLICATIONS

BLADE, Sep. 1997, p. 95. On information and belief, the tool shown in the Ed Halligan advertisement was offered for sale prior to the filing date (6/12/97) of the present application.

*Primary Examiner*—David A. Scherbel
*Assistant Examiner*—Benjamin M. Halpern
*Attorney, Agent, or Firm*—Renner, Otto,Boisselle & Sklar, L.L.P.

[57] ABSTRACT

A tool including a first member, a second member, and a connector pivotally connecting the members together. The first and second members are pivotal relative to each other to convert the tool between a closed condition whereat the members overlie each other and an extended condition whereat the members extend from each other. The first member and/or the second member includes a tooling component which may be used when the tool is in the extended condition. The tool having an exterior surface defined by the first member, the second member, and the pivotal connector when the tool is in the closed condition. The tool may be carried on a keyring along with a set of keys whereby it may be conveniently carried in a pocket or purse.

21 Claims, 3 Drawing Sheets

12
50a
58
50o
56
50n
50m
66
50l
50b
50c
52
50d
50e
50f
54
50g
50h
64
50k
60
50j
50i 14
72
70a
70b
70c
74
70d
82
70e
70f
70g
76
70h
78
70i
70j
70k
70m
70l
70n
70o

12'
58'
50a'
50o'
56'
50n'
50m'
66'
50l'
50b'
50c'
50d'
50e'
54'
50f'
50g'
50h'
64'
50k'
60'
50j'
50i'

14'
72'
70a'
70b'
70c'
74'
70d'
70e'
70f'
78'
70g'
80'
70h'
70i'
70j'
70k'
70l'
70m'
82'

KEYRING TOOL

FIELD OF THE INVENTION

The present invention relates as indicated to a tool and more specifically to a tool which is constructed to be convenient to carry at almost all times, preferably on a keyring.

BACKGROUND AND SUMMARY OF THE INVENTION

A multitude of hand tools are known which are useful in accomplishing a variety of tasks. For example, a knife is used to cut, trim, or strip articles. A screwdriver is used to insert screws into and/or retract screws from threaded openings. A drill is used to provide relatively precise openings on a surface. A hacksaw is used to sever metal items. A wire cutter is used to divide a wire into sections of a desired length. An assortment of individual or multi-function hand tools are commonly stored in one location, such as a tool chest, so that they can be withdrawn and used for the tooling task presented. This arrangement works quite well in some settings, such as an industrial work station or home work bench, where these tasks are repeated over and over again in the course of completing a project.

During day-to-day activities, tasks are sometimes encountered which require the use of a specific hand tool. Very often, the situation occurs remote from the tool chest and requires only a single use of a hand tool. For example, a single cut may be required in a shoe string while walking in the neighborhood. A screw may loosen in a pair of eyeglasses while shopping at the grocery store. While one alternative is to wait until returning home/work to perform the task, having a hand tool available for immediate use is the more preferable option.

During traveling, tasks are also encountered which require the use of a specific hand tool. For example, an airline baggage tag may need to be cut from a suitcase. A screw in a child's travel toy may need to be tightened. With particular reference to outdoor travel activities such as camping, hiking, and biking, many hand tools may be necessary to set-up camp and/or maintain equipment. While traveling with a tool chest is one solution, this is probably not practical since most travelers (especially campers, hikers, and bikers) prefer to pack as light as possible.

The present invention provides a hand tool which is constructed to be convenient to carry at almost all times. In this manner, the tool is available where and when a task presents itself, without having to resort to alternative tooling arrangements and/or without having to wait until return to a tool chest. The preferred tool comprises a first member, a second member, and a connector pivotally connecting the members together. The first and second members are pivotal relative to each other to convert the tool between a closed condition whereat the members overlie each other and an extended condition whereat the members extend from each other. The first member and/or the second member includes at least one, and preferably a plurality of, tooling components (such as a screwdriver, a drill, a knife, and a hacksaw) which are exposed for use when the tool is in the open condition. Additionally, the first member and/or the second member may include a tooling component (such as a wire cutter or screwdriver) exposed for use when the tool is in a condition between the closed condition and the open condition.

The tool according to the present invention may be conveniently carried in the closed condition in a pocket or purse and, when a tooling task presents itself, the tool may be converted to the open condition to perform the task. The tool is preferably "case-less" in that it has an exterior surface defined by the first member, the second member, and the pivotal connector when the tool is in the closed condition. In other words, the tool does not have a separate casing or housing surrounding or enclosing the tooling component. In this manner, the tool may be constructed in an essentially two-piece form, thereby making its assembly efficient and Rs assembled shape/weight suitable for convenient carrying. Specifically, the first and second members may each consist essentially of flat planar body having a substantially uniform thickness formed in one piece, such as by stamping sheet metal.

The tool according to the present invention may be locked in the closed condition, for carrying, and/or may be locked in the open condition for use of the tooling component(s). This locking is preferably accomplished by locking components integral to the first member and the second member, such as an integral notch-tab mating arrangement between the members. This integral locking arrangement allows the tool to still have an essentially two-piece construction and allows the tool to be made by an efficient assembly process.

In the tool according to the present invention, the first and second members preferably form a keyring hole for attachment to a keyring when the tool is in the closed condition. Also preferably, the first and second members form an opening in the keyring hole when the tool is converted from the closed condition to the open condition to release the keyring. In this manner, the tool may be stored on a keyring in the closed condition and then released from the keyring for use when a tooling task presents itself. The tool is preferably shaped and sized to resemble a key when in the closed condition whereby it will blend in appearance with keys on a keyring when being carried in a purse or pocket.

These and other features of the invention are fully described and particularly pointed out in the claims. The following descriptive annexed drawings set forth in detail certain illustrative embodiments of the invention, these embodiments being indicative of but a few of the various ways in which the principles of the invention may be employed.

DETAILED DESCRIPTION

Figure 4:
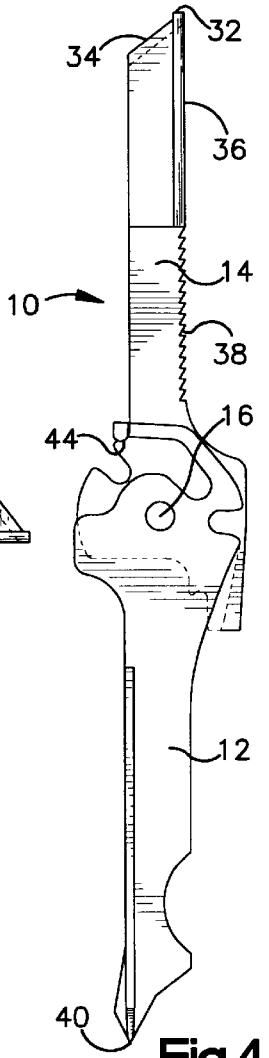
FIG. 4 is a front plan view of the tool, the tool being shown in an extended condition with an approximately 180° relative pivot between the members.
Figure 3:
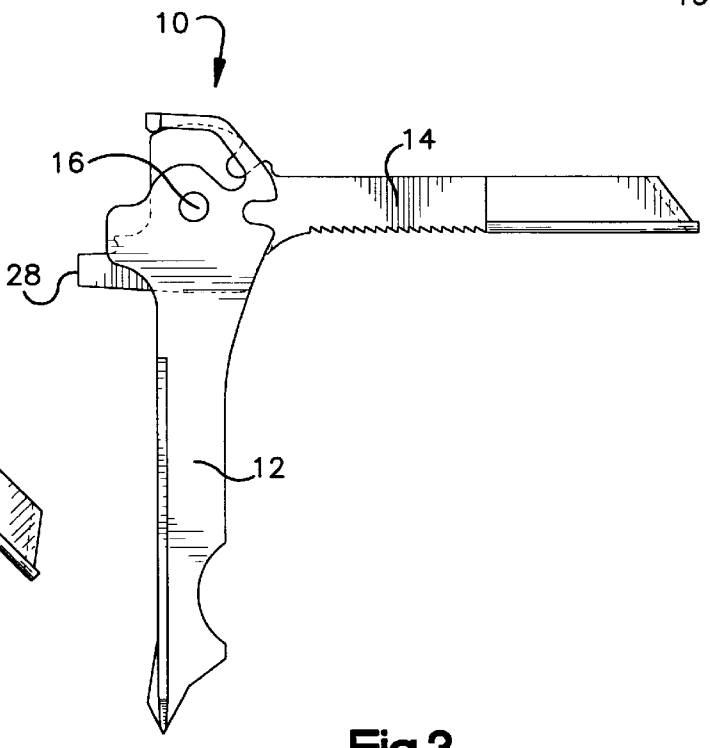
FIG. 3 Is a front plan view of the tool, the tool being shown in a more open condition with an approximately 90° relative pivot between the members.

A tool 10 according to the present invention is shown in FIGS. 1–4. As is explained in more detail below, the tool 10 is designed to be convenient to carry at almost all times. In this manner, the tool 10 is available where and when a task presents itself, without having to resort to alternative tooling arrangements and/or without having to wait to return to a tool chest.

The tool 10 has an essentially two-part construction and comprises a first member 12 and a second member 14 coupled together via a pivotal connection 16. The two members 12 and 14 may be pivoted relative to each other to convert the tool 10 between a closed condition (0° relative pivot between the members) whereat the members overlie each other and an extended condition (180° relative pivot between the members) whereat the members extend from each other. (See FIGS. 1 and 4.) The pivotal connection 16 preferably comprises a rivet extending through aligned openings in the members 12 and 14.

When the tool 10 is in the closed condition, surfaces of the members 12 and 14 form the outer casing of the tool. More specifically, when the tool 10 is in the closed condition, it includes a top surface, a bottom surface, and lateral side surfaces. The top surface is defined by the top surface of the second member 14, portions of the top surface of the first member 12 which the second member 14 does not overlay, and a top exposed portion of the connector 16. The bottom surface of the tool 10 is defined by the bottom surface of the first member 12, portions of the bottom surface of the second member 14 which the first member 12 does not overlay, and a bottom exposed portion of the connector 16. The lateral side surfaces of the tool 10 are defined by the stacked lateral sides of the first and second members 12 and 14. In this manner, the tool 10 is "case-less" in that it has an exterior surface defined by the first member 12, the second member 14, and the pivotal connector 16 when the tool 10 is in the closed condition. (In other words, the tool does not have a separate casing or housing surrounding or enclosing the tooling component.) This design allows the tool 10 to be constructed in an essentially two-piece form, thereby making its assembly efficient and its assembled shape/weight suitable for convenient carrying.

Figure 1:
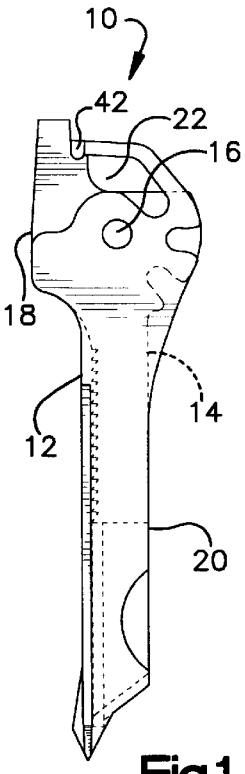
FIG. 1 is nt plan view of a tool according to the present invention, the tool including two members pivotally coupled together, the tool being shown in a closed condition with an approximately 0° relative pivot between the members.

When the tool 10 is in the closed condition shown in FIG. 1, the two members 12 and 14 form a key-shape structure. More specifically, the members 12 and 14 form an upper head portion 18 and a lower shank portion 20. The head portion 18 is roughly circular or polygonal in shape and resembles the part of a key which is held when inserting the key into a lock. The shank portion 20 is a substantially elongated rectangular shape and resembles the part of a key containing the key bits which are inserted into the lock to be opened.

When the tool 10 is in the closed condition, the two members 12 and 14 also form a closed keyring hole 22 in the head portion 18. As the tool 10 is converted towards the extended condition (see FIG. 2), the keyring hole 22 is opened thereby releasing the keyring so that the tool 10 may be conveniently used. In this manner, the tool 10 may be stored on a keyring in the closed condition and then released from the keyring for use when a tooling task presents itself.

Figure 2:
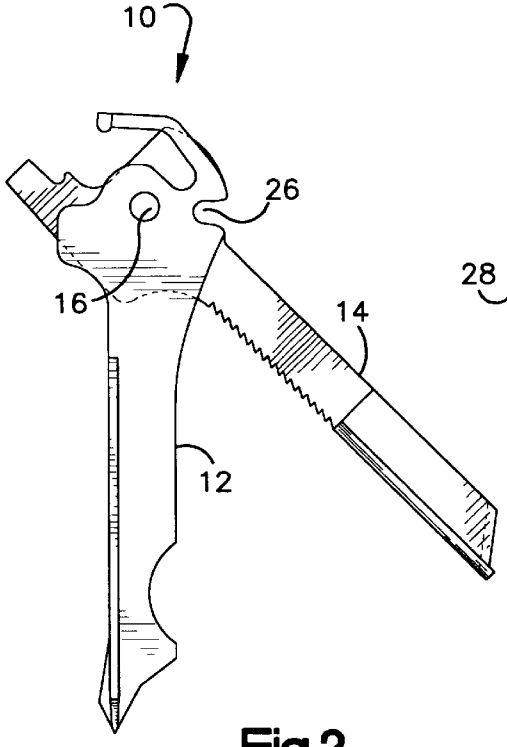
FIG. 2 is a front plan view of the tool, the tool being shown in a partially open condition with an approximately 45° relative pivot between the members.

When the tool 10 is in the partially open condition shown in FIG. 2 (approximately 45° relative pivot between the members 12 and 14), the tool 10 provides a wire cutter 26. Specifically, the members 12 and 14 form a U-shape slot into which a wire may be inserted. As the tool 10 is converted to the more open condition shown in FIG. 3 (approximately 90° relative pivot between the members), the inserted wire will be cut. Also, when the tool 10 is in the more open condition shown in FIG. 3, it provides a flat blade screwdriver 28.

When the tool 10 is in the extended condition shown in FIG. 4 (approximately 180° relative pivot between the members), it provides multiple tooling components. Specifically, the tool 10 includes upper components forming a flat blade screwdriver 32, a drill 34, a knife 36, and a hacksaw 38. (Preferably, the screwdriver 28 would differ in structure from the screwdriver 32 to increase the utility of the tool. For example, component 28 could form a #1 flat blade screwdriver and component 32 could form a #0 flat blade screwdriver.) Also, the tool 10 includes lower components forming a Phillips screwdriver 40, that is a screwdriver having a cross-shaped pointed tip for use on a screw having two slots crossing at the center of the head.

The tool 10 is held, or locked, in the closed condition (FIG. 1) and the extended condition (FIG. 4) by locking structures integral to the first and second members 12 and 14. Specifically, the tool 10 is held in the open condition by locking structure 42 which comprises a notch-tab mating arrangement between the first member 12 and the second member 14. The tool 10 is held in the closed condition by locking structure 44 which also comprises a notch-tab mating arrangement between the first member 12 and the second member 14. The locking structures 42 and 44 are designed so that the tool 10 will remain locked in the closed condition unless the second member 14 is pulled in the counterclockwise direction away from the first member 12 and will remain locked in the extended condition unless the second member 14 is pushed in the clockwise direction towards the first member 12. This integral locking arrangement allows the tool 10 to still have an essentially two-piece construction and to still be made by an efficient assembly process.

Figures 5, 6, 7, 8:
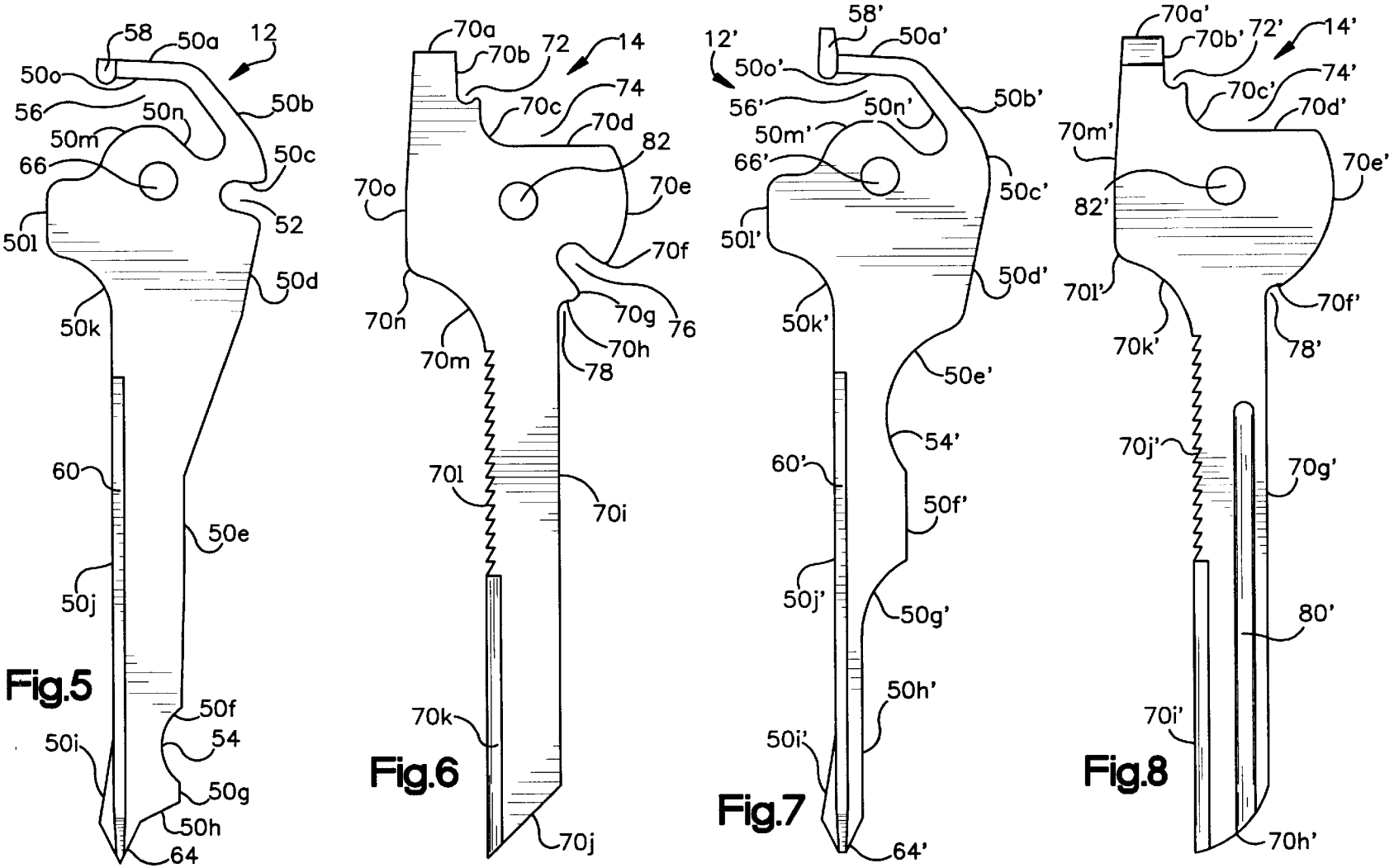
FIG. 5 is a front view of one of the two members of the tool.
FIG. 6 is a front view of the other of the two members of the tool.
FIG. 7 is a front view of one of two members of an alternate form of the tool.
FIG. 8 is a front view of the other of the two members of the alternate form of the tool.

The first member 12 is shown enlarged and isolated from the other components of the tool 10 in FIG. 5. The first member 12 is essentially a flat planar body having a uniform thickness of approximately one sixteenth of an inch which is formed in one piece, such as by stamping sheet metal. The first member 12 has edge portions 50 which define a U-shape slot 52, a quarter-moon shape slot 54, and crooked finger shape slot 56. The first member 12 also includes a raised tab 58, a raised rectangular ledge 60, a pointed cross-shaped tip 64. The edge portions 50 also define an area including an opening 66.

The shape and geometry of the first member 12 is best described by referring to FIG. 5. As shown, the perimeter of the first member 12, when viewed in a clockwise fashion, is defined by the raised tab 58, a horizonal edge portion 50*a*, an outwardly sloped edge portion 50*b*, an inwardly curved edge portion 50*c*, an inwardly sloped edge portion 50*d*, a vertical edge 50*e*, an inwardly curved edge portion 50*f*, a short vertical edge portion 50*g*, an inwardly sloped edge portion 50*h*, the cross-shaped tip 64, an inwardly sloped edge portion 50*i*, a vertical edge portion 50*j*, a convex circular comer edge portion 50*k*, a rounded rectangular edge portion 50*l*, a parabola-shape edge portion 50*m*, a tilted U-shaped end portion 50*n*, and a horizontal edge portion 50*o*. The edge portion 50*c* defines the U-shape slot 52, the edge portion 50*f* defines the quarter moon-shape slot 54, and the edge portions 50*m*, 50*n*, and 50*o* define the crooked finger shape slot 56. The raised ledge 60 is flush with the vertical edge portion 50*j* and merges with the cross-shaped tip 64 at its lower end. The opening 66 is located within the area defined by the edge portions 50*a*–50*d* and the edge portions 50*k*–50*n*.

The second member 14 is shown enlarged and isolated from the other components of the tool 10 in FIG. 6. The second member 14 is essentially a flat planar body having a uniform thickness of approximately one sixteenth of an inch. The member 14 is formed in one piece, such as by stamping sheet metal. The member 14 has edge portions 70 which define a hooked J-shape notch 72, an oblong cut-out 74, a U-shape slot 76, and another hooked notch 78. The edge portions 70 also define an area including an opening 82.

The shape and geometry of the second member 14 is best described by referring to the drawings, specifically FIG. 6. As shown, the perimeter of the second member 14, when viewed in a clockwise fashion, is defined by a horizontal edge portion 70*a*, a hooked J-shape edge portion 70*b*, a concave circular corner edge portion 70*c*, a horizontal edge portion 70*d*, a concavely curved edge portion 70*e*, a convexly curved edge portion 70*f*, a concavely curved edge portion 70*g*, a notched edge portion 70*h*, a vertical edge portion 70*i*, an inclined bottom edge portion 70*j*, a vertical blade edge portion 70*k*, a vertical toothed edge portion 70*l*, a convexly rounded comer edge portion 70*m*, a concavely rounded corner edge portion 70*n*, and a vertical edge portion 70*o*. The lower section of the edge portion 70*b* defines the hooked notch 72, the edge portions 70*c* and 70*d* define the oblong cut-out 74, the edge portion 70*f* defines the U-shape slot 76, and the edge portion 70*h* defines the hooked notch 78. The opening 82 is located within the area surrounded by the edge portions 70*a*–70*g* and edge portions 70*m*–70*o*.

When the members 12 and 14 are assembled into the tool 10, the openings 66 and 82 are aligned. The connector 16 passes through the aligned openings 66 and 82 in such a manner that the members 12 and 14 may pivot relative to one another. The exposed ends of the connector 16 are enlarged or otherwise shaped to prevent passage through the openings 66 and 82 whereby the members 12 and 14 are pivotally connected together.

When the tool 10 is in the closed condition, the upper portion of the first member 12 (defined by edge portions 50*a*–50*d* and 50*k*–50*o*) and the upper portion of the second member 14 (defined by edge portions 70*a*–70*h* and 70*m*–70*o*) form the upper head portion 18 of the key-shape structure. The lower portion of the first member 12 (defined by edge portions 50*e*–50*j*) and the lower portion of the second member 14 (defined by edge portions 70*i*–70*l*) define the lower shank portion 20 of the key-shape structure. (See FIG. 1.)

When the tool 10 is in the closed condition, the edge portion 50*f* defining the quarter-moon shape slot 54 in the first member 12 exposes a gripping surface on the second member 14. In this manner, there may be a two-side gripping of the second member 14 to pull (or pivot) the second member 14 when converting the tool 10 to an open condition. Also, when the tool 10 is in the closed condition, the blade edge portion 70*k* and the toothed edge portion 70*l* of the second member 14 rest against the ledge 60. In this manner, the ledge 60 shields the edge portions 70*k* and 70*l* from incidental lateral contact.

Also when the tool 10 is in the closed condition, the edge portions 50*m*–50*o* defining the crooked finger-shape slot 56 in the first member 12 and the edge portions 70*c*–70*d* defining the oblong cut-out 74 in the second member 14 coordinate to form the tool's keyring hole 22. Specifically, the hole 22 will be defined by edge portions 50*n*, 50*o*, 70*c* and 70*d*. In other words, the edge portion 70*c* of the second member 14 blocks the open end of the slot 56. As the tool 10 is converted to an open condition, and the edge portion 70*c* is moved away and the open end of the slot 56 is unblocked thereby opening the keyring hole 22 for release of the keyring. Additionally, the edge portion 70*d* will push the keyring towards the open end of the slot 56 thereby essentially ejecting the keyring from the tool 10.

The U-shape slots 52 and 76 coordinate to form the wire cutter 26 in the assembled tool 10. When the tool 10 is in a partially open condition (approximately 45° relative pivot between the members), the slots 52 and 76 overlie each other and form a U-shape opening into which the wire may be inserted. (See FIG. 2.) As the tool 10 is moved to a more open condition (approximately 90° relative pivot between the members), the edge portion 70*f* defining the second member's slot 76 will move past the slot 52 thereby cutting or slicing the wire inserted therein. (See FIG. 3.) Also, when the tool 10 is in the more open condition, the vertical edge 70*a* forms the screwdriver 28. (See FIG. 3).

When the tool 10 is in the extended condition (approximately 180° relative pivot between the members 12 and 14), the edge portions of the second member 14 form the various tooling components. Specifically, the edge portion 70*a* forms the flat blade screwdriver 32 and the drill 34, the edge portion 70*k* forms the knife 36 and the edge portion 70*l* forms the hacksaw 38. Also, the pointed cross-shaped tip 64 of the first member 12 forms the Phillips screwdriver 40. (See FIG. 4.)

The tab 58 in the first member 12 and the notch 72 in the second member 14 form the integral locking structure 42 which holds, or locks, the tool 10 in the closed condition. (See FIG. 1.) The same tab 58 in the first member 12 and the notch 78 in the second member 14 form the integral locking structure 44 which holds, or locks the tool 10 in the extended condition. (See FIG. 4.)

Turning now to FIGS. 6 and 7, a modified member 12' and a modified member 14' are shown. As with the members 12 and 14, the members 12' and 14' are each an essentially planar body having a uniform thickness of approximately one sixteenth of an inch. The members 12' and 14' are preferably formed in one piece, such as by stamping sheet metal.

The first member 12' is similar in many ways to the first member 12. Specifically, the first member 12' has edge portions 50' which define a quarter-moon shape slot 54' and crooked finger shape slot 56'. The first member 12' also has a raised tab 58', a raised rectangular ledge 60', a pointed cross-shaped tip 64', and an opening 66'. The first member 12' does not, however, have a U-shape slot similar to the slot 52 in member 12. Also, the raised tab 58' extends above the adjacent horizontal edge portion, in contrast to the raised tab 58 in the first member 12. Still further, the quarter-moon shape slot 54' is placed differently when compared to the slot 54 in the first member 12.

The perimeter of the first member 12', when viewed in a clockwise fashion, is defined by the raised tab 58', a horizonal edge portion 50*a*', an outwardly sloped edge portion 50*b*', a rounded comer portion 50*c*', an inwardly sloped edge portion 50*d*', an inwardly curved edge portion 50*e*', a vertical edge portion 50*f*', an inwardly curved edge portion 50*g*', a vertical edge portion 50*h*, the cross-shaped tip 64', an inwardly sloped edge portion 50*i*', a vertical edge portion 50*j*', a convex circular comer edge portion 50*k*', a rounded rectangular edge portion 50*l*', a parabola-shape edge portion 50*m*', a tilted U-shaped end portion 50*n*', and a horizontal edge portion 50*o*'. The edge portion 50*e*' defines the quarter moon-shape slot 54' and the edge portions 50*m*', 50*n*', and 50*o*' define the crooked finger shape slot 56'. The raised ledge 60' is flush with the vertical edge portion 50*j* and merges with the cross-shaped tip 64' at its lower end. The opening 66' is located within the area defined by the edge portions 50*a*–50*d* and edge portions 50*k*'–50*n*'.

The second member 14' is similar in many ways to the first member 14. Specifically, the member 14' has edge portions 70' which define a hooked notch 72', an oblong cut-out 74', and another hooked notch 78'. The edge portions 70' also define an area including an opening 82'. However, the second member 14' does not include a U-shape slot such as the U-shape slot 76 in member 14. Also, an additional feature of the second member 14' is decorative grooves 80' which, when the tool is in the closed condition, will be situated on the shank portion of the key-shape structure thereby enhancing the key-like appearance of the tool in the closed condition.

The perimeter of the second member 14', when viewed in a clockwise fashion, is defined by a horizontal edge portion 70*a*', a hooked J-shape edge portion 70*b*', a concave circular corner edge portion 70*c*', a horizontal edge portion 70*d*', a concavely curved edge portion 70*e*', a notched edge portion 70*f*', a vertical edge portion 70*g*', a rounded bottom edge portion 70*h*', a vertical blade edge portion 70*i*', a vertical toothed edge portion 70*j*', a convexly rounded corner edge portion 70*k*', a concavely rounded comer edge portion 70*l*', and a vertical edge portion 70*m*'. The lower section of the edge portion 70*b*' defines the hooked notch 72', the edge portions 70*c*' and 70*d* define the oblong cut-out 74', and the edge portion 70*f* defines the hooked notch 78'. The opening 82' is located within the area surrounded by the edge portions 70*a*'–70*e*' and edge portions 70*k*'–70*m*'. The decorative grooves 80' are positioned parallel with, and slightly inwardly from, the vertical edge 70*g*'.

The members 12' and 14' are assembled into the tool in the same manner as members 12 and 14, namely by pivotally connecting them with a connector passing through aligned openings 66' and 82'. When the tool is the closed condition, the corresponding portions of the members 12' and 14' will form the upper head portion and the lower shank portion of the key-shaped structure. The edge portion 50*e*' defining the quarter-moon shape slot 54' in the first member 12' will expose a gripping surface on the second member 14', the blade edge portion 70*i*' and the toothed edge portion 70*j*' of the second member 14' will rest against the ledge 60'. The edge portions defining the crooked finger-shape slot 56'in the first member 12' and the edge portions defining the oblong cut-out 74' in the second member 14' will coordinate to form the tool's keyring hole.

In the assembled tool, the edge portions of the members 12' and 14' will coordinate to form tooling components in much the same manner as the members 12 and 14. Specifically, the pointed cross-shaped tip 64' of the first member 12' forms a Phillips screwdriver, and the vertical edges 70*a*', 70*i*', and 70*j*' of the second member, form a screwdriver, drill, knife and hacksaw, respectively. Also the tab 58' in the first member 12' and the notches 72' and 78' in the second member 14' coordinate to form the integral locking structure.

Figure 9:
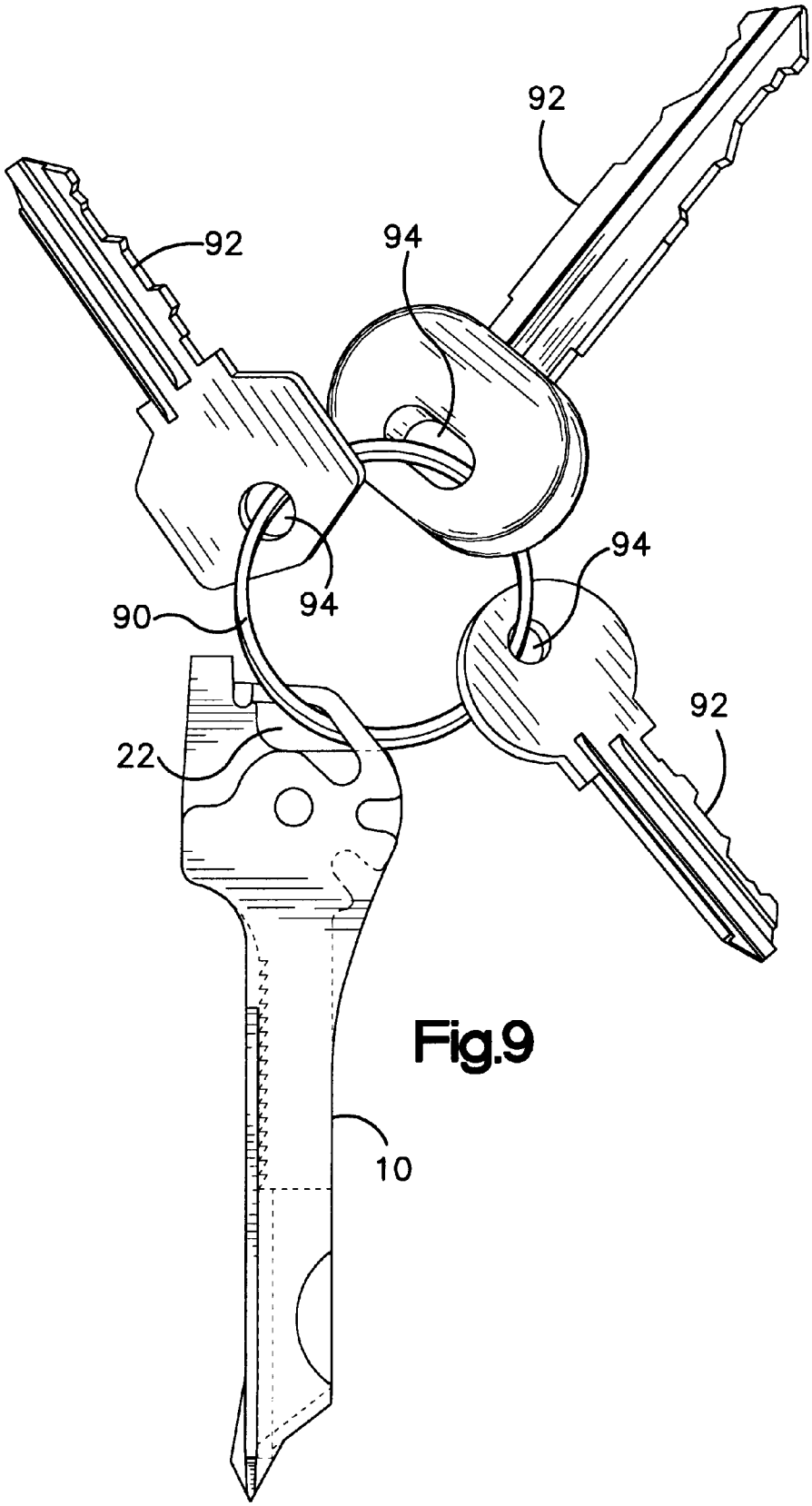
FIG. 9. is a front view of a keyring, keys attached to the keyring, and the tool according to the present invention also attached to the keyring.

One may now appreciate that the present invention provides a tool 10 which may be constructed in an essentially two-piece form, thereby making its assembly efficient and its assembled shape/weight suitable for convenient carrying, specifically on a keyring 90 with a set of keys 92, as is shown in FIG. 9. The keyring 90 comprises a closed loop of material and each of the keys 92 has a keyring hole 94 through which the keyring 90 passes. To use the tool 10, it is released from the keyring 90 and converted to the extended condition for use of the desired tooling component. After the tooling task has been completed, the tool 10 is converted to the closed condition and reattached to the keyring 90. In the preferred tool 10, the releasing/reattaching is accomplished while the tool 10 is being converted between the closed condition and the open condition.

It should be noted that throughout the description, directional terms (such as "upper", "lower", "top", "bottom", "clockwise", "counterclockwise", etc.) have been used to describe various features of the tool 10. These terms only refer to the illustrated orientation of the tool 10 and are used solely for clarity in explanation. The terms are not intended to limit the invention to the illustrated orientation or any other orientation. Other orientations and/or directional parameters are possible with, and contemplated by, the present invention.

Although the invention has been shown and described with respect to certain preferred embodiments, it is obvious that equivalent and obvious alterations and modifications will occur to others skilled in the art upon the reading and understanding of this specification. The present invention includes all such alterations and modifications and is limited only by the scope of the following claims.

What is claimed is:

1. A tool comprising a first member, a second member, and a connector pivotally connecting the members together:

the first and second members being pivotal relative to each other to convert the tool between a closed condition whereat the members overlie each other and an extended condition whereat the members extend from each other;

at least one of the first and second members including a tooling component which may be used when the tool is in the extended condition;

the first and second members forming a head portion and a thinner roughly rectangular shank portion extending therefrom when the tool is in the closed condition; and the head portion including a keyring hole whereby the tool may be stored on a keyring.

2. A tool as set forth in claim 1 wherein the connector is positioned between the head portion and the shank portion.

3. A tool as set forth in claim 2 wherein the keyring hole is opened when the tool is converted from the closed condition to the extended condition to release the keyring.

4. A tool as set forth in claim 1 wherein the keyring hole is opened when the tool is converted from the closed condition to the extended condition to release the keyring.

5. A tool as set forth in claim 4 wherein the first member and the second member each include integral components coordinating to form a locking structure in the head portion which locks the tool in the closed condition.

6. A tool as set forth in claim 5 wherein the locking structure which locks the tool in the closed condition comprises a notch-tab mating arragngement between the first member and the second member.

7. A tool as set forth in claim 6 wherein the notch-tab mating arrangement comprises a tab on the first member which mates with a notch in the second member.

8. A as tool set forth in claim 1, wherein:

the first member is formed in one piece; and the second member is formed in one piece.

9. A tool as set forth in claim 8, wherein the members are formed in one piece by stamping.

10. A method using the tool of claim 1, said method comprising the steps of:

pivoting the first and second members relative to each other to convert the tool to the extended condition;

using the tooling component; and then pivoting the first and second members relative to each other to convert the tool to the closed condition.

11. In combination, a keyring, a set of keys and the tool set forth in claim 1;

the keyring comprising a closed loop of material;

each of the keys in the set of keys having a keyring hole;

the keyring passing through the keyring holes in the keys and the keyring hole in the tool to thereby store the keys and tool on the keyring.

12. In combination, a keyring, a set of keys and the tool set forth in claim 1;

the keyring comprising a closed loop of material;

each of the keys in the set of keys having a keyring hole;

the keyring passing through the keyring holes in the keys and the keyring hole in the tool to thereby store the keys and tool on the keyring.

13. A method of using the combination of claim 12 said method comprising the steps of:

converting the tool from the closed condition to the extended condition to release the keyring;

using the tooling component;

converting the tool to the closed condition and reattaching the tool to the keyring.

14. A tool comprising a first member, a second member, and a connector pivotally connecting the members together;

the first and second members being pivotal relative to each other to convert the tool between a closed condition whereat the members overlie each other and an extended condition whereat the members extend from each other;

at least one of the first and second members including a tooling component which may be used when the tool is in the extended condition;

the tool having an exterior surface defined by the first member, the second member, and the pivotal connector when the tool is in the closed condition;

wherein the first member and the second member are pivoted approximately 180° relative to each when the tool is in the extended condition;

wherein the first and second members form a head portion and a thinner roughly rectangular shank portion extending therefrom when the tool is in the closed condition, and wherein the head portion includes a keyring hole whereby the tool may be stored on a keyring.

15. A tool as set forth in claim 14 wherein the connector is positioned between the head portion and the shank portion.

16. A tool comprising a first member, a second member, and a connector pivotally connecting the members together;

the first and second members being pivotal relative to each other to convert the tool between a closed condition whereat the members overlie each other and an extended condition whereat the members extend from each other;

at least one of the first and second members including a tooling component which may be used when the tool is in the extended condition;

the tool having an exterior surface defined by the first member, the second member, and the pivotal connector when the tool is in the closed condition;

wherein the first member and the second member each include integral components coordinating to form a locking structure which locks the tool in the closed condition;

wherein the first and second members form a head portion and a thinner roughly rectangular shank portion extending therefrom when the tool is in the closed condition, and wherein the head portion includes a keyring hole whereby the tool may be stored on a keyring.

17. A tool as set forth in claim 16 wherein the connector is positioned between the head portion and the shank portion.

18. A tool comprising a first member, a second member, and a connector pivotally connecting the members together;

the first and second members being pivotal relative to each other to convert the tool between a closed condition whereat the members overlie each other and an extended condition whereat the members extend from each other;

at least one of the first and second members including a tooling component which may be used when the tool is in the extended condition;

the tool having an exterior surface defined by the first member, the second member, and the pivotal connector when the tool is in the closed condition;

wherein the first member and the second member each include integral components coordinating to form a locking structure which locks the tool in the extended condition;

wherein the first and second members form a head portion and a thinner roughly rectangular shank portion extending therefrom when the tool is in the closed condition, and wherein the head portion includes a keyring hole whereby the tool may be stored on a keyring.

19. A tool as set forth in claim 18, wherein the connector is positioned between the head portion and the shank portion.

20. A tool comprising a first member, a second member, and a connector pivotally connecting the members together;

the first and second members being pivotal relative to each other to convert the tool between a closed condition whereat the members overlie each other and an extended condition whereat the members extend from each other;

at least one of the first and second members including a tooling component which may be used when the tool is in the extended condition;

the tool having an exterior surface defined by the first member, the second member, and the pivotal connector when the tool is in the closed condition;

the first member and the second member each being formed in one piece; and the first member and the second member each consisting essentially of a flat planar body having a substantially uniform thickness;

wherein the first and second members form a head portion and a thinner roughly rectangular shank portion extending therefrom when the tool is in the closed condition, and wherein the head portion includes a keyring hole whereby the tool may be stored on a keyring.

21. A tool as set forth in claim 20, wherein the connector is positioned between the head portion and the shank portion.

* * * * *